US006889917B2

(12) United States Patent
Fahy et al.

(10) Patent No.: US 6,889,917 B2
(45) Date of Patent: May 10, 2005

(54) CLEANING DEVICE WITH UNIVERSAL MOTION QUICK DISCONNECT HEAD

(75) Inventors: Cathal L. Fahy, Columbus, OH (US); Dale Aberegg, Mt. Vernon, OH (US); Vincent A. Macri, Dayton, OH (US); Brian K. Linstedt, Ostrander, OH (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/385,982

(22) Filed: Mar. 10, 2003

(65) Prior Publication Data

US 2004/0178284 A1 Sep. 16, 2004

(51) Int. Cl.[7] ..... B05B 7/02
(52) U.S. Cl. ..... 239/525; 239/526
(58) Field of Search ..... 239/394, 451, 239/456, 457, 525, 526, 530, 587.1, 600; 15/144.1, 144.2; 403/13, 109.8, 322.4

(56) References Cited

U.S. PATENT DOCUMENTS

| | | | | |
|---|---|---|---|---|
| 2,509,687 A | | 5/1950 | Lee | |
| 3,058,136 A | | 10/1962 | Rachlin | |
| 3,360,286 A | | 12/1967 | Smyth | |
| 3,483,662 A | | 12/1969 | Ames | |
| 3,600,100 A | | 8/1971 | Arones et al. | |
| 3,713,744 A | | 1/1973 | Sims | |
| 3,794,217 A | | 2/1974 | Munchel | |
| 3,820,905 A | | 6/1974 | Sims | |
| 4,114,223 A | * | 9/1978 | Buchanan | 15/228 |
| 4,190,922 A | | 3/1980 | Eliss | |
| 4,225,998 A | * | 10/1980 | Thielen | 15/231 |
| 4,349,361 A | * | 9/1982 | Scott et al. | 55/357 |
| 4,407,039 A | | 10/1983 | Moss | |
| 4,423,534 A | * | 1/1984 | Lyman et al. | 15/410 |
| 4,475,262 A | * | 10/1984 | Downer | 15/210.1 |

(Continued)

FOREIGN PATENT DOCUMENTS

| | | | |
|---|---|---|---|
| DE | 10015506 A1 | | 12/2001 |
| EP | 0908135 a1 | * | 4/1999 |
| JP | 09056654 A | * | 3/1997 |
| WO | WO 95/32661 A1 | | 12/1995 |
| WO | WO 03/092965 A2 | | 11/2003 |

OTHER PUBLICATIONS

A two– page website excerpt entitled "Grab–it Go Mop Instructions", dated Mar. 26, 2003.

*Primary Examiner*—William E. Tapolcai
*Assistant Examiner*—Mohammad M. Ali

(57) ABSTRACT

A trigger actuated aerosol spray cleaning device having a cleaning head mounted by a quick disconnect coupler to be independently pivotal about at least two axes. In one form, the coupler has a body with a socket receiving a plug end of the cleaning device which is retained by a button actuated, spring biased latching ring preventing axial separation from the coupler until the button is depressed. In another form, spring biased opposing jaws releasably clamp the head to the device. A swivel member pivotally mounts to either the coupler body or opposing jaws along one axis and to the cleaning head at a second axis. The swivel action in either case can be temporarily disabled by a sliding locking feature.

18 Claims, 10 Drawing Sheets

U.S. PATENT DOCUMENTS 4,648,149 A * 3/1987 Hampton et al. ..... 15/360
4,663,796 A 5/1987 Helling et al.
4,700,429 A * 10/1987 Martin et al. ..... 15/377
4,769,869 A 9/1988 Benitez
4,796,325 A * 1/1989 Bortman ..... 15/167.2
4,811,449 A * 3/1989 Kobayashi ..... 15/231
4,885,876 A * 12/1989 Henke ..... 451/503
4,886,191 A 12/1989 Yoshitomi
4,940,415 A * 7/1990 Westergren ..... 439/192
5,033,155 A 7/1991 Klotz
5,099,539 A 3/1992 Forester
5,220,707 A 6/1993 Newman, Sr. et al.
5,343,587 A 9/1994 Findley
5,354,347 A * 10/1994 McCoy et al. ..... 96/330
5,410,771 A 5/1995 Bereza
5,426,809 A * 6/1995 Muta ..... 15/228
5,455,980 A * 10/1995 Buchanan ..... 15/228
5,461,749 A * 10/1995 Ahlberg et al. ..... 15/228
5,579,558 A 12/1996 Newman, Jr. et al.
5,815,878 A * 10/1998 Murakami et al. ..... 15/231
5,823,592 A 10/1998 Kalidindi
5,888,006 A 3/1999 Ping et al.
5,901,402 A * 5/1999 Williams ..... 15/144.1
5,930,863 A 8/1999 Samuelsson
5,960,508 A 10/1999 Holt et al.
6,003,191 A 12/1999 Sherry et al.
6,029,308 A 2/2000 Smith
6,045,622 A 4/2000 Holt et al.
6,048,123 A 4/2000 Holt et al.
6,058,552 A * 5/2000 Hanan ..... 15/228
6,101,661 A 8/2000 Policicchio et al.
6,145,152 A 11/2000 Ward
6,202,250 B1 * 3/2001 Kenmochi et al. ..... 15/231
6,250,830 B1 6/2001 Clark
6,311,366 B1 * 11/2001 Sepke et al. ..... 15/412
6,397,427 B1 6/2002 Bryngelsson
6,412,138 B1 7/2002 MacMillan
6,425,701 B1 7/2002 Jacobs
6,484,346 B2 11/2002 Kingry et al.
6,487,745 B2 12/2002 Specht
6,532,630 B1 * 3/2003 Newman et al. ..... 16/429
6,571,421 B1 * 6/2003 Sham et al. ..... 15/320
6,631,535 B2 * 10/2003 Sergyeyenko et al. ..... 15/410
2001/0046407 A1 11/2001 Kunkler et al.
2002/0148057 A1 10/2002 Hobden
2002/0168216 A1 11/2002 Policicchio et al.
2003/0009839 A1 1/2003 Streutker et al.
2003/0024066 A1 2/2003 Kennedy
2003/0028988 A1 2/2003 Streutker et al.
2003/0031508 A1 2/2003 Fechter
2003/0077105 A1 4/2003 Hall et al.
2003/0209263 A1 * 11/2003 Bell et al. ..... 134/187
2003/0226230 A1 * 12/2003 Hertrick et al. ..... 15/320
2003/0226231 A1 * 12/2003 Hisrich et al. ..... 15/323

* cited by examiner

FIG. 7
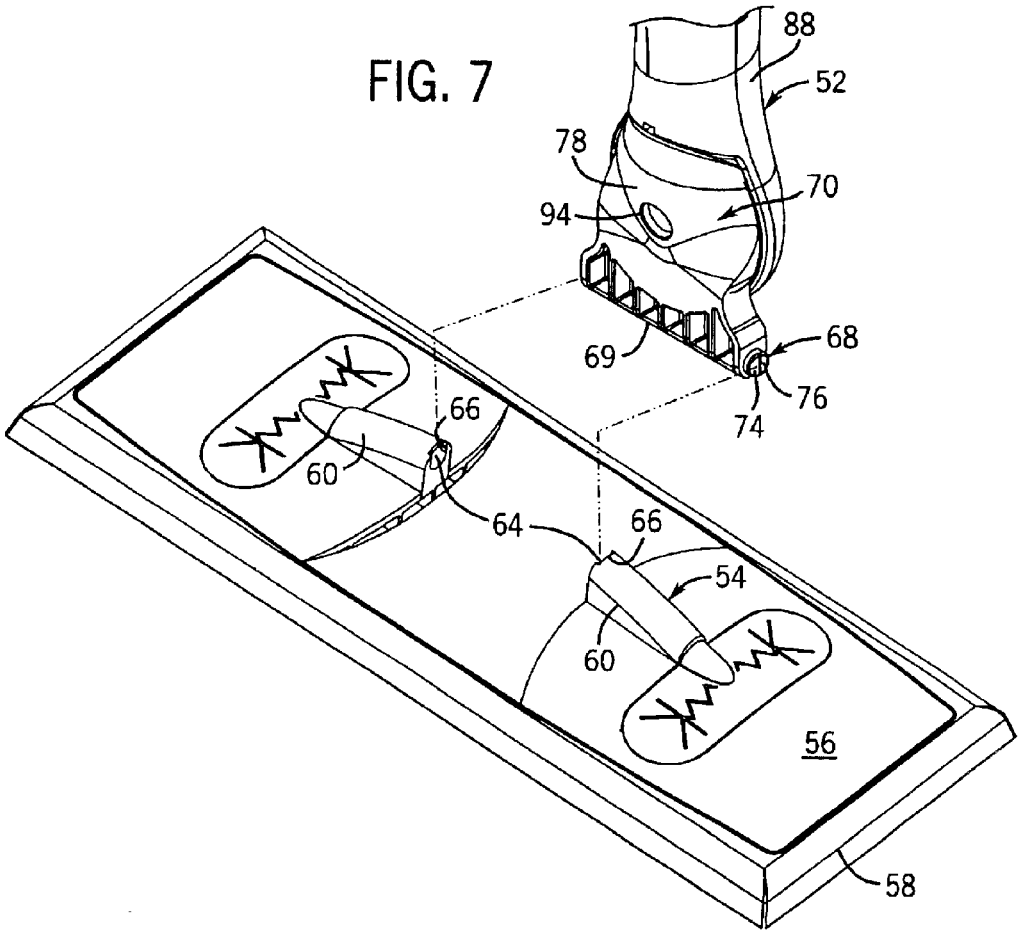
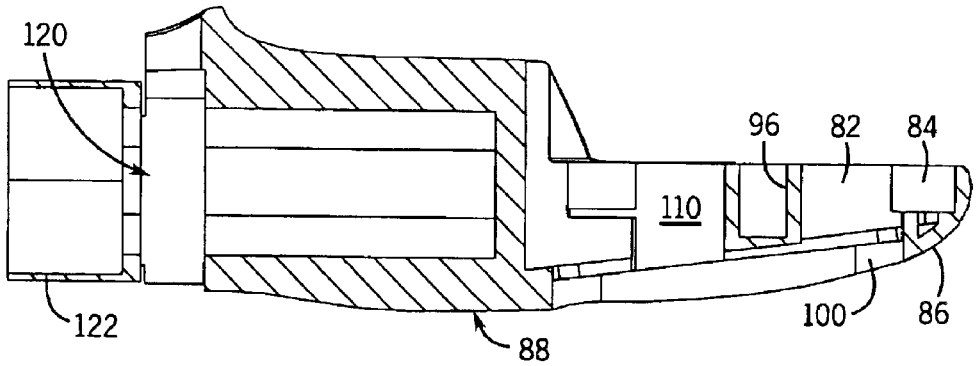
FIG. 17

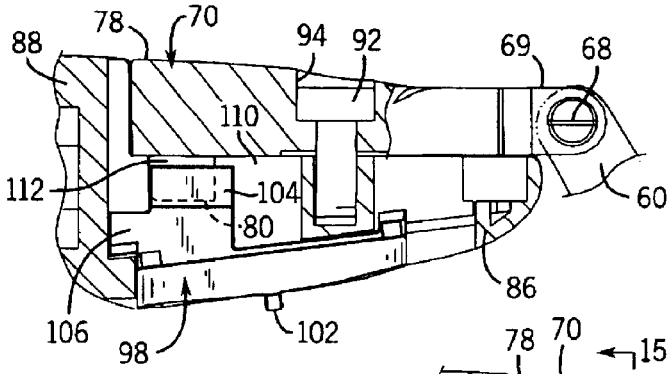
FIG. 13
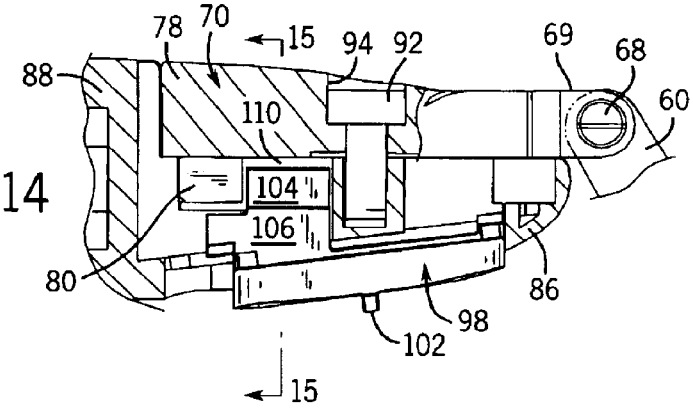
FIG. 14
FIG. 16
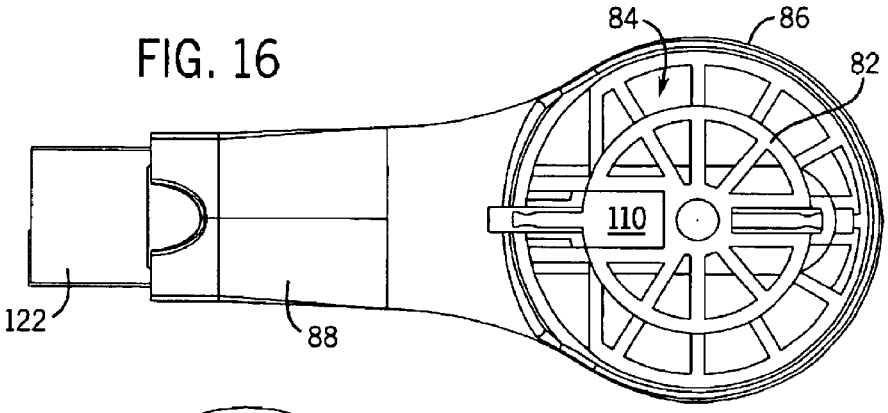
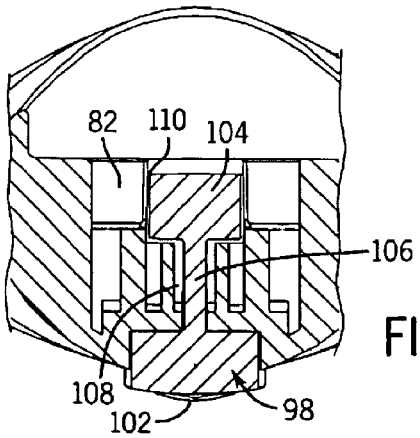
FIG. 15

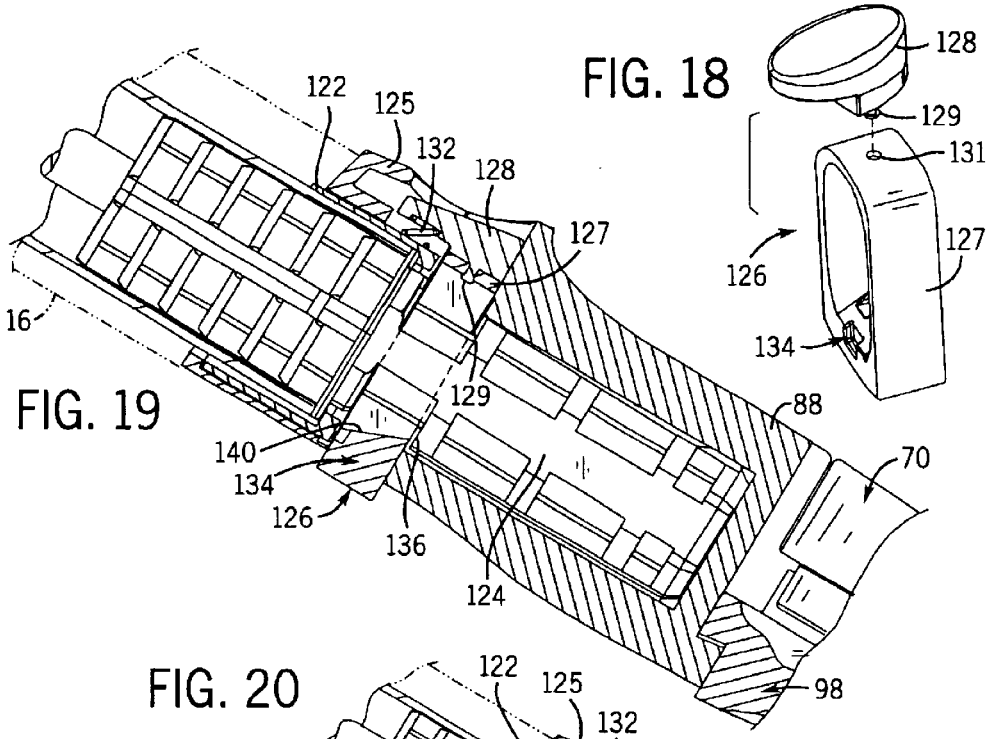
FIG. 19
FIG. 18
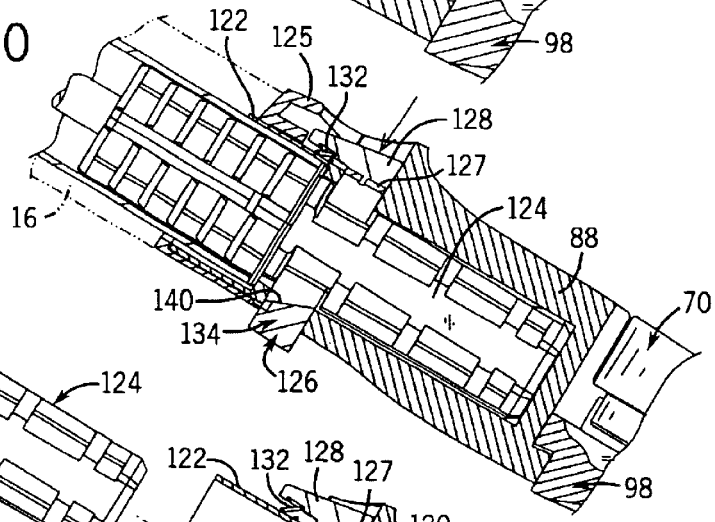
FIG. 20
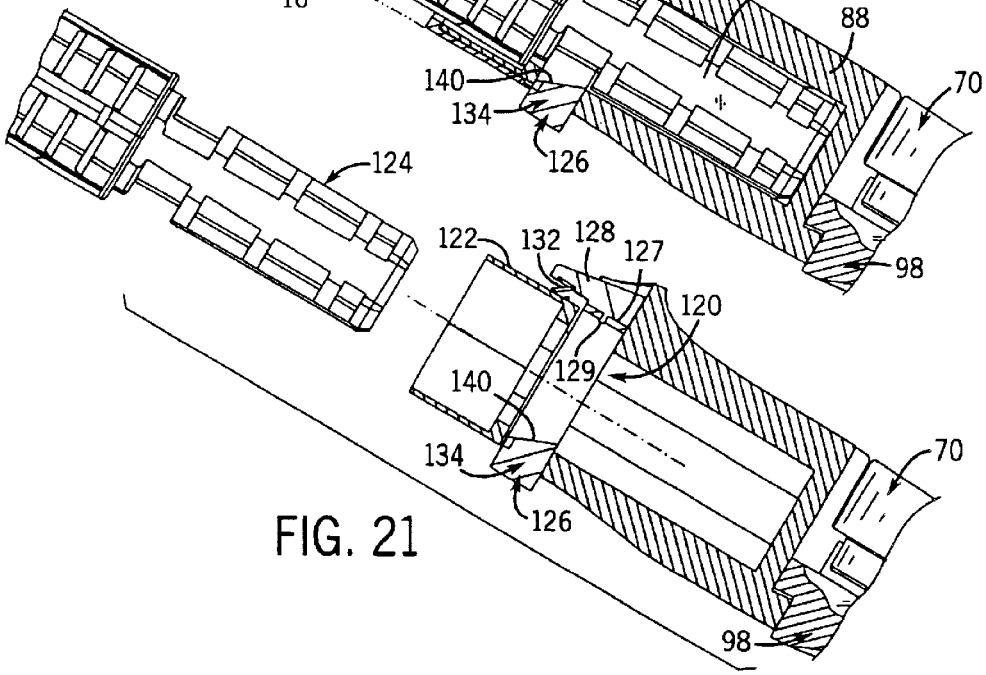
FIG. 21

CLEANING DEVICE WITH UNIVERSAL MOTION QUICK DISCONNECT HEAD

CROSS-REFERENCE TO RELATED APPLICATIONS

Not applicable.

STATEMENT OF FEDERALLY SPONSORED RESEARCH/DEVELOPMENT

Not applicable.

FIELD OF THE INVENTION

The present invention relates to cleaning devices and in particular to cleaning devices using aerosol spray cans for dispensing a cleaning agent to assist in cleaning.

BACKGROUND OF THE INVENTION

Cleaning products have been developed that dispense a cleaning agent onto the surface being cleaned near the cleaning head of the device. Some such devices dispense gravity fed liquid cleansers and some dispense the cleaner in the form of an aerosol spray. The latter of these types of cleaning devices have an aerosol canister (containing the cleaning chemical and the propellant) mounted to the device typically between the cleaning head and a handle. The canister can be mounted to a pole to assist in reaching high ceilings or underneath furniture, to reduce straining one's arms, neck and back. Some of these devices also are actuated remotely by a trigger, which keeps the chemical from contacting the skin of the user and also assists in consistent spraying. See e.g. U.S. Pat. Nos. 3,679,319, 3,794,217, 4,789,084, 4,886,191 and 5,779,155. The disclosures of these patents are hereby incorporated reference as if fully set forth herein.

Conventional aerosol spraying cleaning devices are designed to work with one size of canister. Increasingly, however, cleansers are sold in various sized canisters. Thus, for ore application, cleaning windows for example, the window cleaning agent may be in a canister of lesser size than would be optimal for floor cleaning. In this regard, it may be desirable to use smaller canisters for hand-held devices in which the canister is held off the ground or overhead by the user (as when cleaning windows) to reduce the weight of the device and thereby user strain.

Existing cleanser dispensing cleaning devices provide adjustable cleanings heads that can be assembled quickly by the user. For example, S.C, Johnson & Son, Inc, the assignee of the present invention, offers the Grab-it Go Mop (a trademark of S.C. Johnson & Son, Inc.) trigger actuated aerosol spray cleaning/polishing device. This device has a pivoting cleaning head which allows the housing and its handle to pivot with respect to the cleaning head about two independent axes. The products are sold disassembled in small box packages. The cleaning head has a pivot mount that is easily snapped onto a connector yoke attached to a housing holding the aerosol canister. However, the cleaning head is not designed to be disconnected easily. In particular, the interfitting parts have ramped surfaces that allow an easy, one time only assembly, but also have opposed flat surfaces that resist separation.

It is desirable to allow different types of cleaning heads to be quickly interchanged onto the device, particularly without sacrificing the robust pivotal connection. Accordingly, an improved cleaning device is desired.

SUMMARY OF THE INVENTION

In one aspect the present invention provides a cleaning device having a cleaning head, a handled main body and a quick disconnect coupler. The coupler is adapted to releasably attach the cleaning head to the main body and allow independent relative pivotal movement of the cleaning head with respect to the main body about two or more perpendicular, preferably non-planar, axes.

Preferably, the coupler includes a swivel pivotal with respect to the main body about the first axis and pivotal with respect to the cleaning head about the second axis. The cleaning head has a fixed pivot mount to which the swivel is pivotally connected along the second axis. In a preferred form then, the body (and handle) of the device can pivot nearly 180 degrees between the front and back sides of the cleaning head. In addition, the body (and handle) can also swivel independently (nearly 120 degrees) between lateral sides of the cleaning head. Still further motion about a third perpendicular axis can be provided. Thus, the coupler provides universal type relative motion allowing the angle of the body with respect to a surface contacted by the cleaning head to be changed within a full 360 degrees.

In one form, the coupler provides a plug and socket connection for attaching the cleaning head to the body of the cleaning device. Here, the coupler can include a body pivotally mounted at one end to the swivel along the first axis and having at a second end a socket receiving a plug end of the main body. Preferably, a button actuated, spring biased latch ring disposed around the plug end of the main ha a catch that engages a radial surface of the plug end to prevent axial separation of the main body from the coupler body. The coupler can also include a lock for disabling the swivel action. Preferably, the lock is slidable by a grip and includes a stop movable into a radial slot in the swivel.

In another form, the coupler provides a clamping connection of between the cleaning head and the main body. Here, the coupler includes opposing jaws releasably clamping to the swivel. The jaws are pivotally connected and biased together by a spring. The swivel includes an opening receiving the jaws. The connection can be pivotal and extend along the second axis. And, the swivel can be in two parts pivotally mating along a third axis with one part engaging the pivot mount of the cleaning head and the other providing the opening receiving the jaws. In this case, the coupler provides a third pivot axis perpendicular to both of the other pivot axes.

In still a more preferred form, the main body further includes an aerosol canister assembly for delivering a chemical from a canister to a desired location adjacent the cleaning head. And, the handle is part of a grip assembly having a trigger for moving an actuator assembly causing the chemical is to be dispensed from the canister when the trigger is depressed. The grip assembly can be part of a housing of the main body or located at an end of an extension wand connected to the aerosol canister assembly allowing remotely actuated spraying.

These and other advantages of the invention will be apparent from the detailed description and drawings. It should be understood that the following merely provides preferred embodiments of the invention. The claims should be looked to in order to understand the full scope of the invention.

BRIEF DESCRIPTION OF THE DRAWINGS

FIG. 7 is an exploded perspective view showing a quick disconnect coupler separated from the cleaning head;

FIG. 13 is a partial detail cross-sectional view taken along line 13—13 of FIG. 4 showing the swivel connection of the coupler with a swivel locking element in an unlocked position;

FIG. 14 is a view similar to FIG. 13 although showing the swivel locking element in a locked position disabling swivel movement;

FIG. 15 is a partial detail cross-sectional view taken along line 15—15 of FIG. 14;

FIG. 16 is a bottom plan view of a coupler body isolated from the swivel and swivel locking element;

FIG. 17 is a side cross-sectional view taken along line 17—17 of FIG. 11;

FIG. 18 is an exploded perspective view of a latch ring;

FIG. 19 is a partial cross-sectional taken along line 19—19 of FIG. 9 showing a plug end of a main body of the device locked into a socket end of the coupler;

FIG. 20 is a view similar to FIG. 19 showing the latch ring moved into a release position out of engagement with the plug end;

FIG. 21 is a view similar to FIG. 19 showing the plug and socket arrangement disconnected;

DETAILED DESCRIPTION OF THE PREFERRED EMBODIMENTS

The present invention provides a trigger actuated cleaning device using an aerosol spray canister to dispense a cleaning agent. The primary focus of this application is a quick disconnect coupler for the cleaning head allowing it to pivot with at least two degrees of freedom. The other components of the cleaning device will be described briefly here, however, a better understanding of a device with similar components can be found in co-pending U.S. application Ser. No. 09/951,632, filed on Sep. 14, 2001 (now allowed), which is hereby incorporated by reference as though fully set forth herein.

Figure 1:
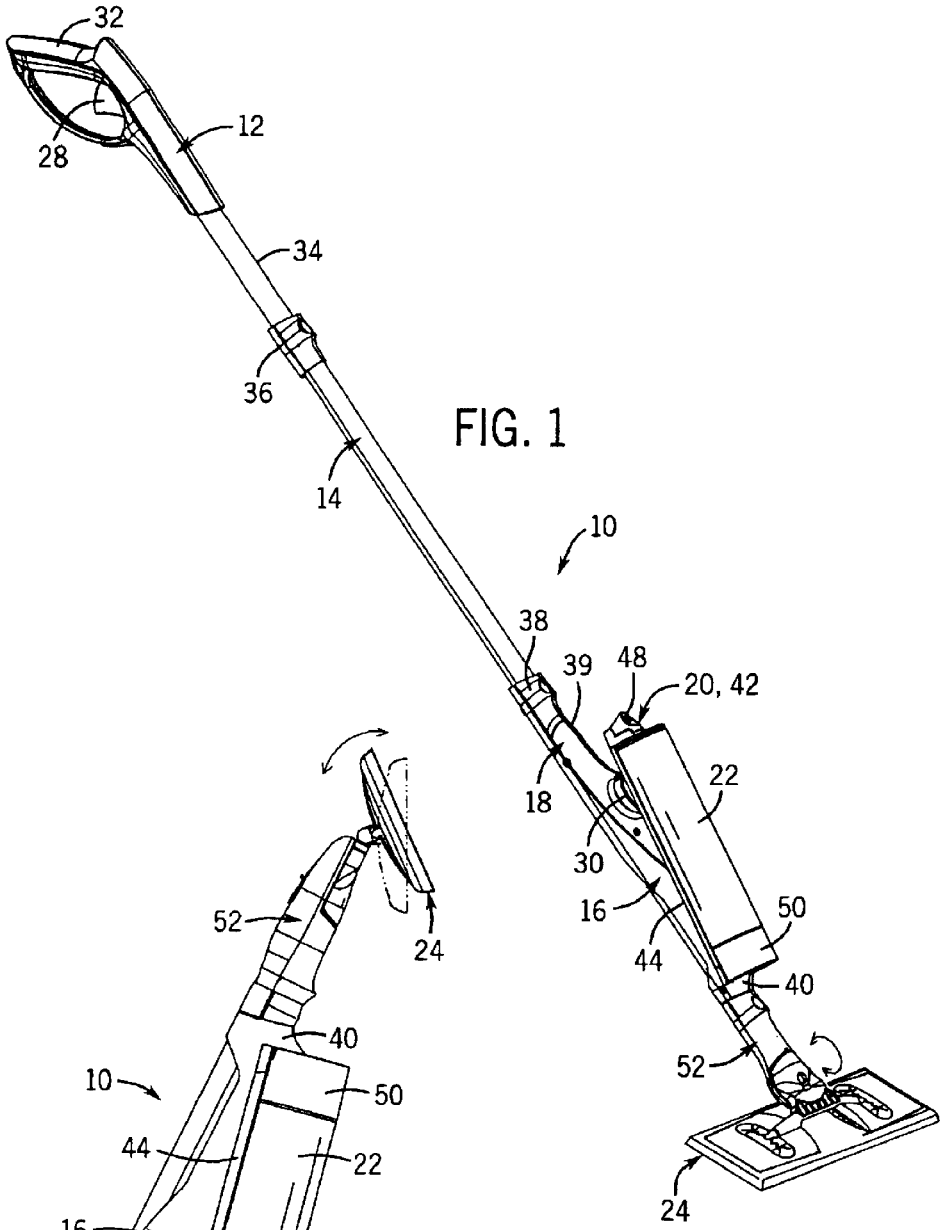
FIG. 1 is a perspective view of a cleaning device having a quick disconnect mounted cleaning head, shown with a remote grip assembly at the end of an extension wand.
Figure 2:
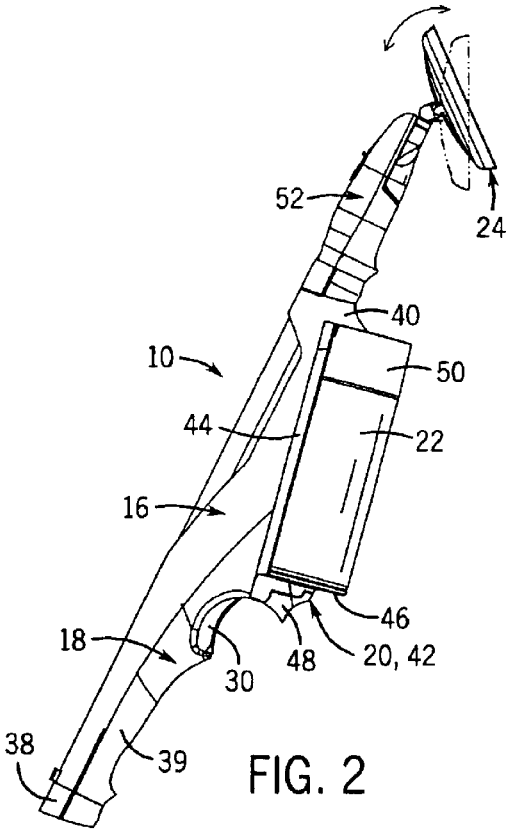
FIG. 2 is a side view of the cleaning device with the extension wand and remote grip assembly removed.

FIG. 1 of the drawings shows the cleaning device 10 of the present invention fully assembled in a mop-like configuration for cleaning floors or out of reach vertical or horizontal surfaces. FIG. 2 shows the cleaning device 10 with an extension wand removed so as to be shorter for cleaning nearby surfaces and to be more suitable for holding upright when cleaning close vertical surfaces, such as windows for example.

Figure 3:
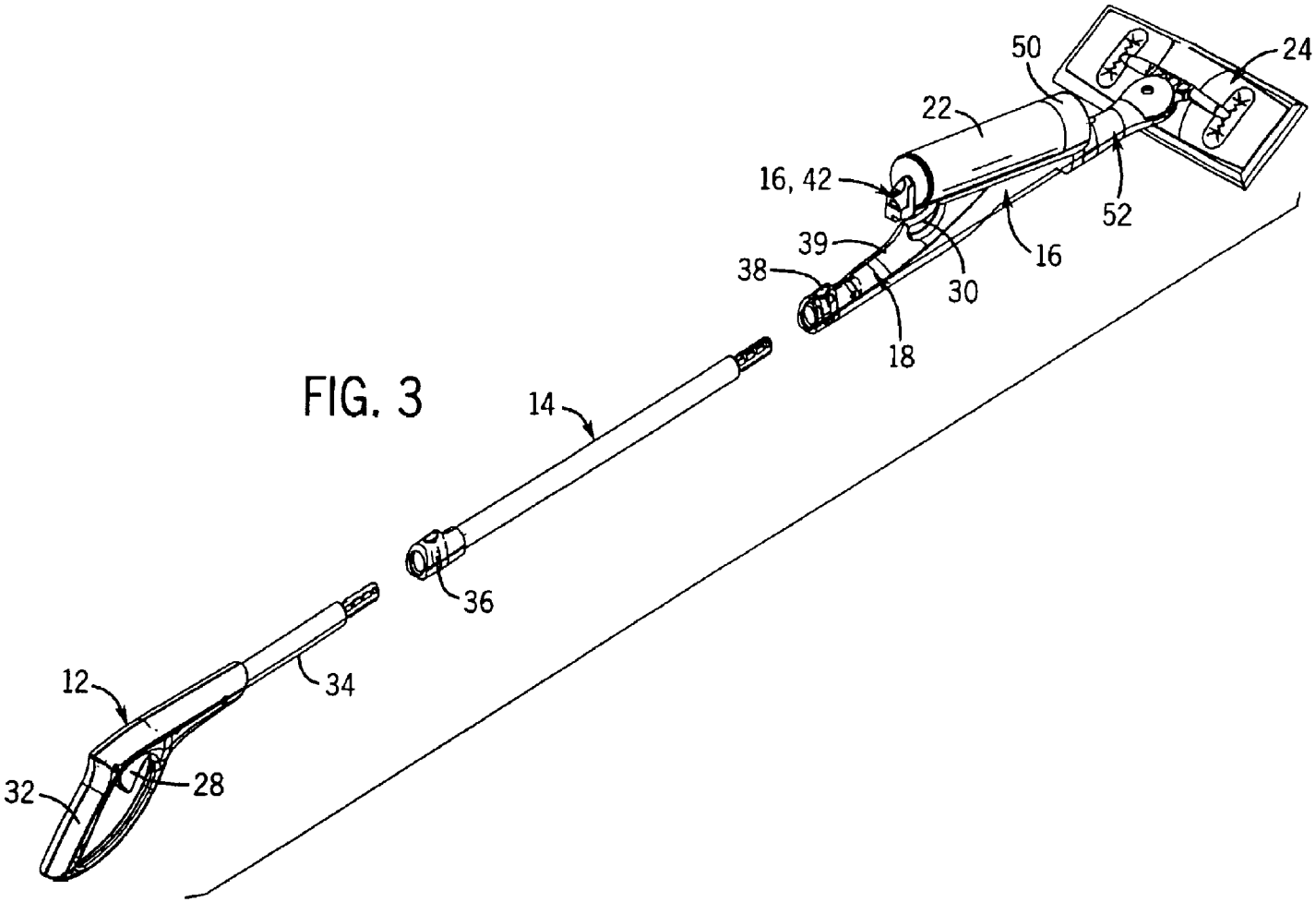
FIG. 3 is an exploded perspective view of the cleaning device as shown in FIG. 1.

With reference to these two figures and FIG. 3, the cleaning device 10 includes as major components a remote grip assembly 12, an extension wand 14, a main body 16 having its own grip assembly 18 and an adjustable retainer assembly 20 holding a canister 22, and a cleaning head 24. Internal to many of these components is a movable actuator assembly (not shown) linking triggers 28 and 130 of the two grip assemblies 12 and 18, respectively, to the valve of the canister 22 for spraying cleaner contained therein near the cleaning head 24.

The remote grip assembly 12 includes a hollow (two-piece) plastic pistol grip housing defining a handle 32 and the pivotally mounted trigger 28 to be operable by an index finger when gripping the handle 32. A hollow shaft extension 34 which plugs into a quick connect socket 36 at one end of the extension wand 14. Similarly, the opposite end of the extension wand 14 plugs into a quick connect socket 38 at the end of the main body 16. The ends of the shaft extension 34 and the extension wand 14 are identical as are the sockets 36 and 38, thus if desired, the extension wand 14 can be removed from the assembly so that the remote grip assembly 12 can by directly connected to the main body 16. As mentioned above and shown in FIG. 2, the remote grip assembly 12 and the extension wand 14 can be detached and the device operated by trigger 30 and held by handle 39 of the main body 16. The grip assembly 12, the extension wand 14 and the main body 16 houses core pieces (not shown) of the actuator assembly that slide in response to movement of either of the triggers 28 and 30 and in turn pivot an actuator lever (not shown) operating the valve of the canister 22.

The canister 22 is aligned and mounted to the main body 16 by the retainer assembly 20, having a toe stop 40, through which an end of the actuator lever protrudes when the triggers 28 and 30 are depressed, a T-shaped rail (not shown) and a heel assembly 42 having a slide 44 riding on the rail. A locking tab (not shown) formed in the rail clicks into one of two receivers at two preset adjustment locations to alternatively hold full or compact sized canisters. A mechanism at the back of the slide 44 has a spring biased latch (not shown) that engages an inside surface of a rim 46 at the bottom of the canister 22. The latch is operated by a thumb operated release lever 48, which when depressed clears the latch from the canister 22. Releasing the release lever 48 resets the latch so that another canister can be snapped in place.

In operation, a user generally utilizes the cleaning device like any conventional poled or hand-held cleaning aerosol device. When the user desires to spray cleaner onto the surface being cleaned, the user simply squeezes either trigger 28 or 30, which pivots a hinged part of an overcap 50 on the canister 22 which in turn moves a valve stem (not shown) to open the canister valve and spray out cleaner. When the triggers 28 and 30 are released, springs (not shown) bias the actuator assembly to its original, non-activated position, which allows the canister valve to close and stop spraying.

Figure 4:
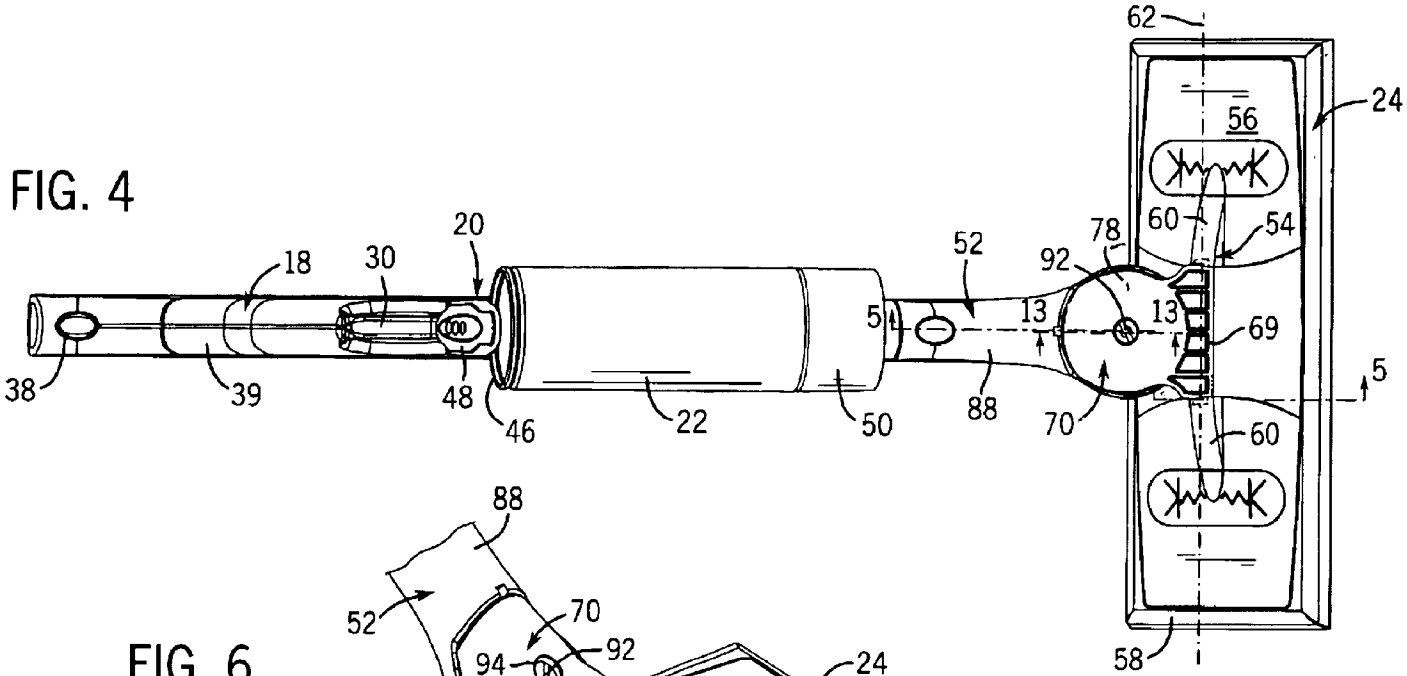
FIG. 4 is a top view of the cleaning device as shown in FIG. 2.
Figure 6:
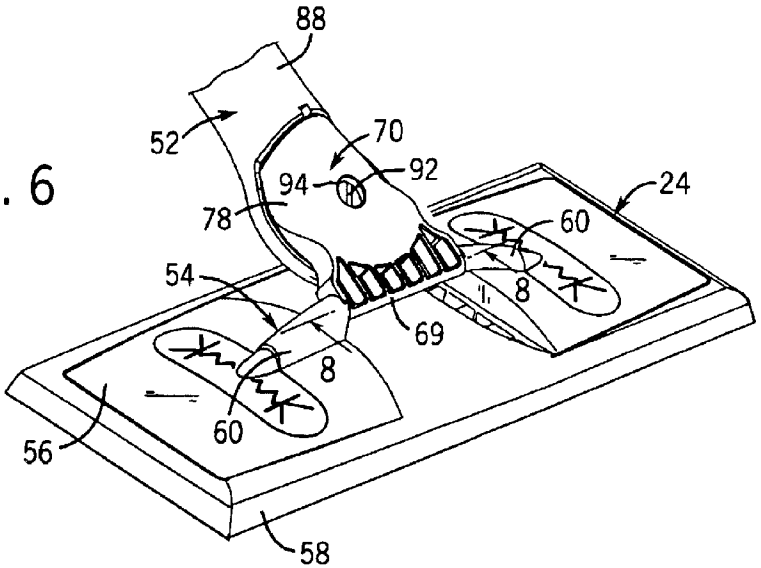
FIG. 6 is a partial perspective view of the cleaning head.

Referring now to FIGS. 4 and 6, the opposite end of the main body 16 connects to the cleaning head 24, as described in detail below, by a quick disconnect coupler 52 mounted to a pivot mount 54 formed as an integral part of the a backing plate 56 supporting a compressible pad 58. The pad 58 can be a substrate for mounting a cleaning cloth or dusting sheet or it may be a sponge or scrubber pad. The plate 56 and pad 58 could of course be replaced by a bristled brush head, wiper blade or any other suitable cleaning implement desired.

More specifically, referring to FIGS. 5-8, the pivot mount 54 is actually two upstanding fixed mounts 60 spaced apart along a pivot axis 62 defining facing pivot grooves 64 with upper notches 66. The two pivot grooves 64 are sized to receive two pivot bosses 68 on opposite lateral sides of a flared section 69 of a swivel 70 component of the coupler 52. The bosses 68 have tapered surfaces 74 that facilitate camming the pivot bosses 68 into the pivot grooves 54 through the notches 66 during assembly. The flat surfaces 76 of the pivot bosses 68, however, resist separation during normal use. Thus, when assembling or disassembling this pivot connection, the coupler 52 should be oriented so that the tapered surfaces 74 are the leading surfaces.

Referring to FIGS. 8-12 and 16, the swivel 70 has a generally circular section 78 with a ribbed ring 80 that fits around a hub 82 in an annular recess 84 at a round end 86 of a coupler body 88. The swivel 70 and coupler body 88 are pivotally joined along a swivel axis 90 by a fastener 92 disposed through a central opening 94 of the swivel 70 and threaded into a bore 96 of the coupler body 88. The swivel axis 90 is disposed in a plane generally perpendicular to the plane containing the pivot axis 62. Ordinarily, the coupler body 88 is free to pivot about the swivel axis 90 until the flared section 69 is stopped by contact with the sides of the coupler body 88.

As shown in FIGS. 10-15, the coupler 52 includes a locking element 98 disposed in a recess 100 in the coupler body 88. The locking element 98 includes a grip section 102 and a stop 104 with a narrowed neck section 106 disposed through a slot 108 in the coupler body 88. The recess 100 and the slot 108 are longer than the respective grip 102 and neck 106 sections to permit the locking element 98 to slide between locked and unlocked positions with respect to the coupler body 88. As shown in FIGS. 14 and 15, when the locking element 98 is in the unlocked position, the stop 104 fits into a radial slot 110 in the hub 82 of the coupler body 88 clear from the ring 80 of the swivel 70. By sliding the locking element 98 to the locked position shown in FIG. 13, the stop 104 fits into a radial slot 112 in the ring 80 (aligned with slot 110) so as to interfere with the swivel 70 and prevent it from pivoting about swivel axis 90. This arrangement allows the swivel to be disabled quickly and easily when not needed or when a more rigid connection is desired.

Figure 5:
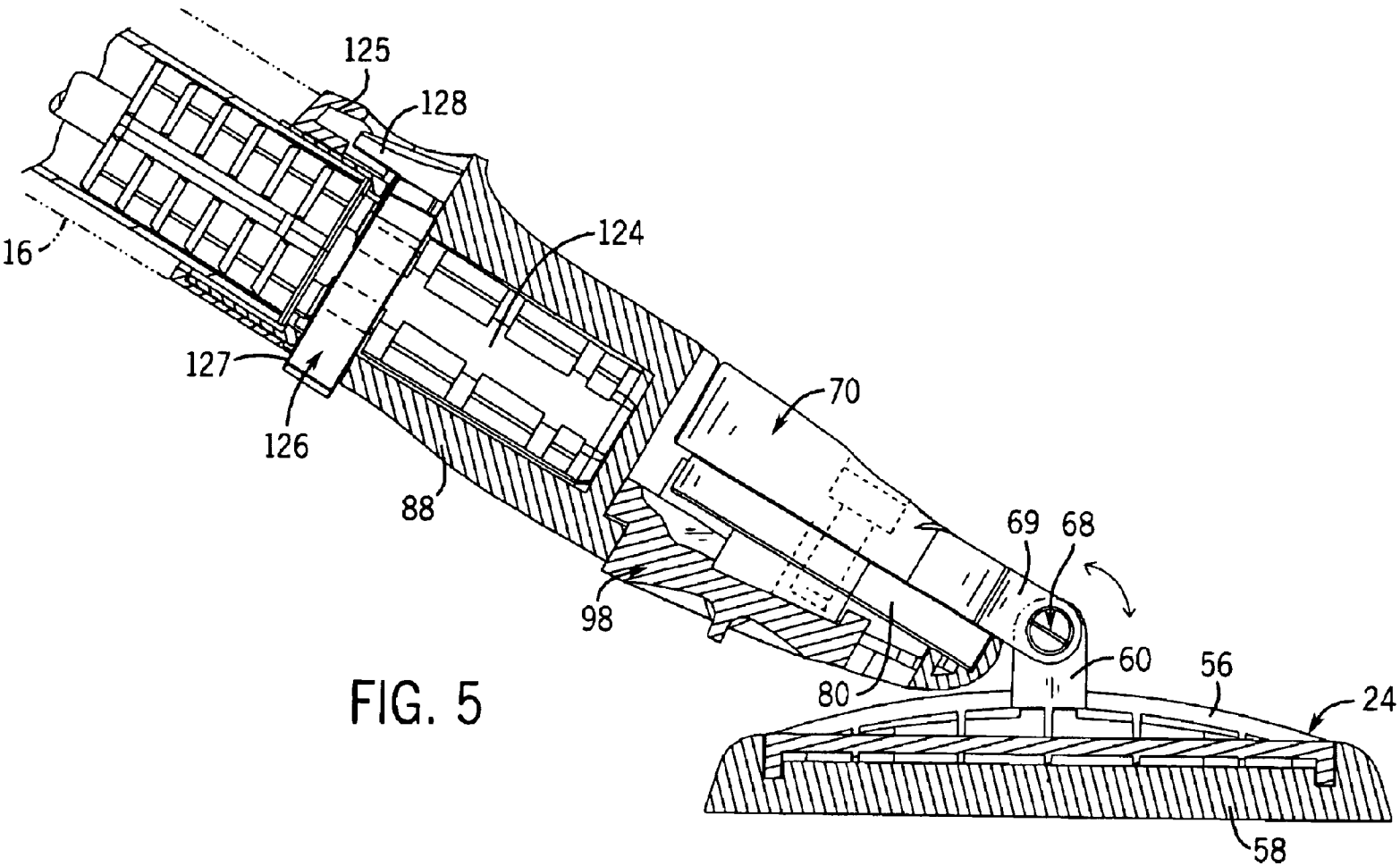
FIG. 5 is a partial cross-sectional view taken along line 5—5 of FIG. 4.
Figure 8:
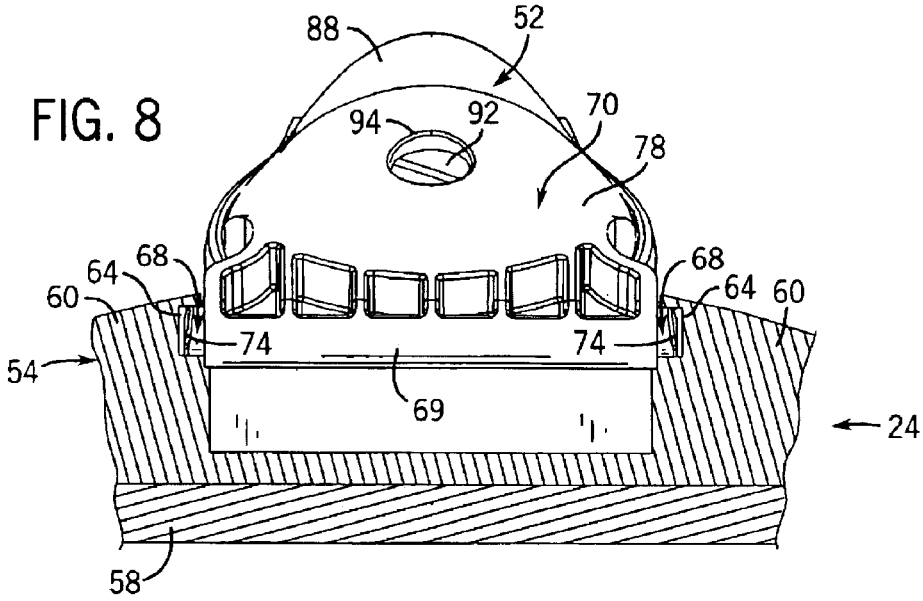
FIG. 8 is a partial cross-sectional view taken along line 8—8 of FIG. 6.
Figure 9:
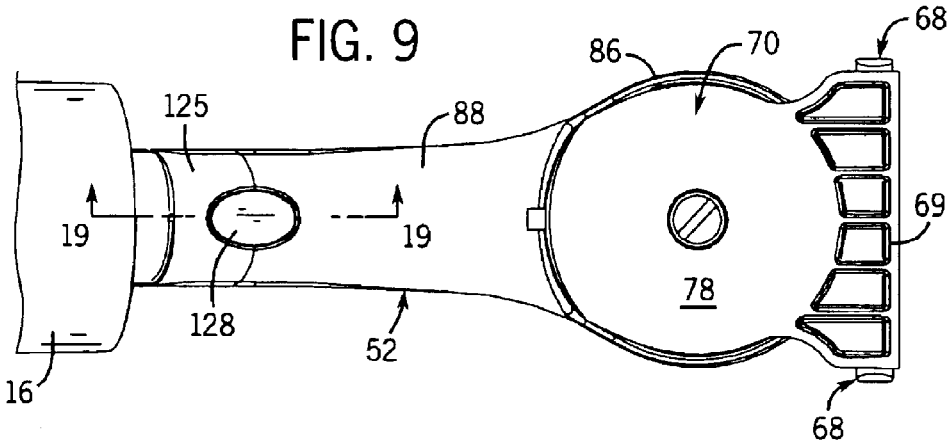
FIG. 9 is a partial plan view showing the coupler without the cleaning head.
Figure 10:
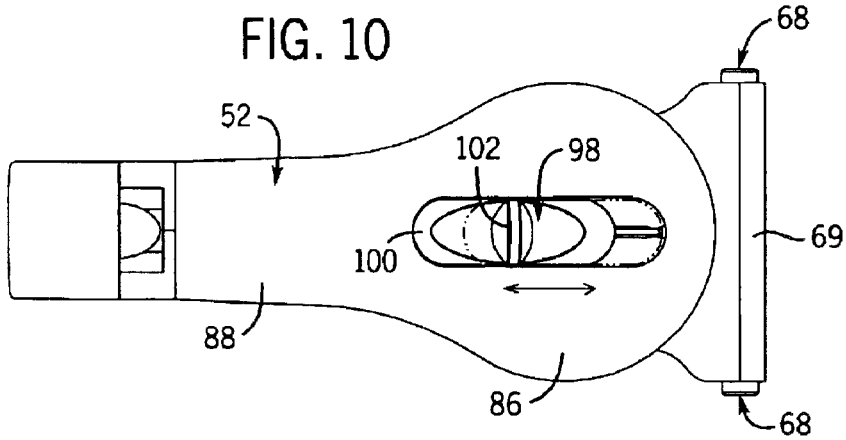
FIG. 10 is an opposite side plan view of the coupler.
Figure 11:
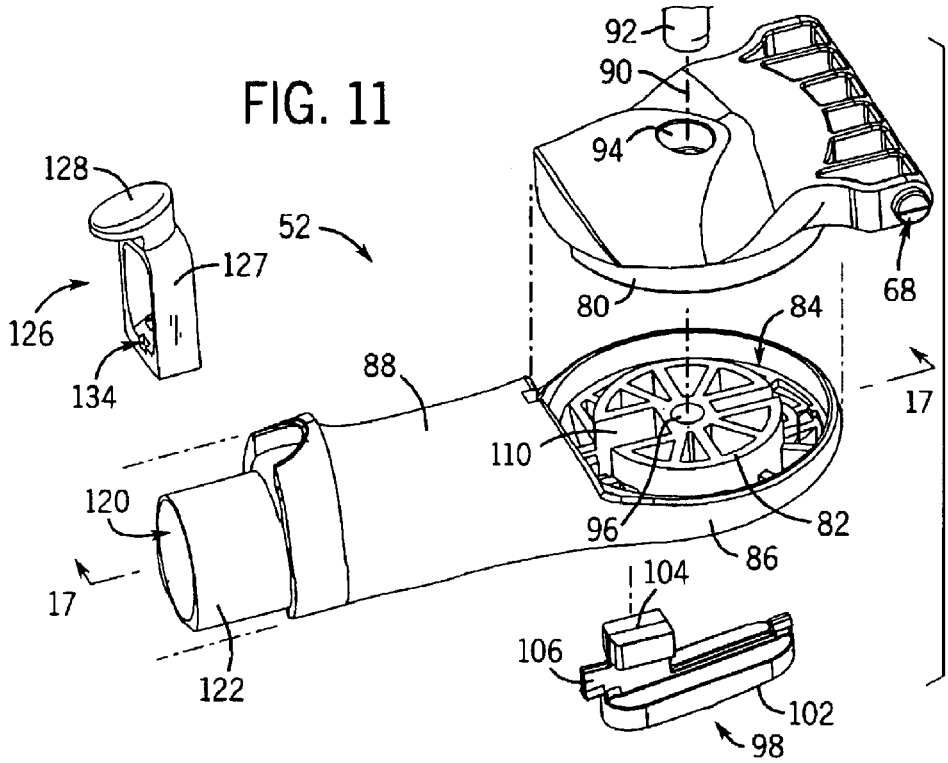
FIG. 11 is an exploded perspective view of the coupler.
Figure 12:
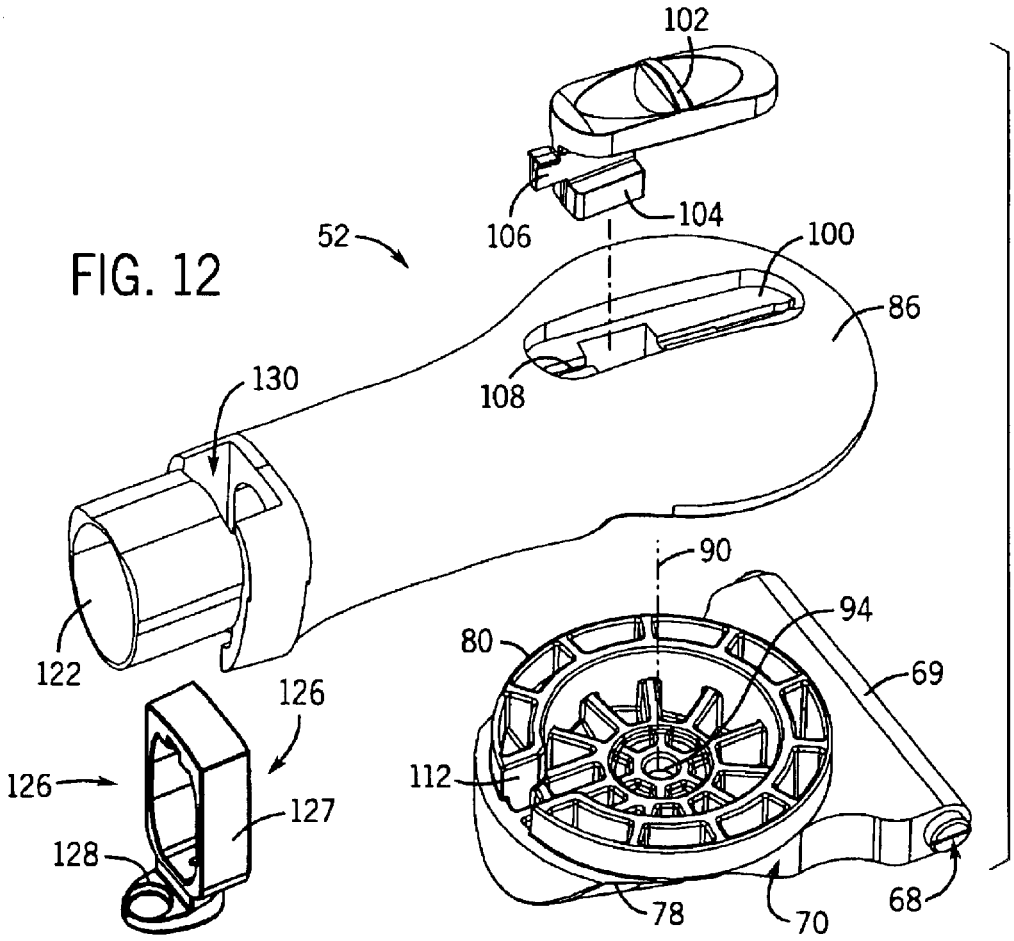
FIG. 12 is a reverse exploded perspective view of the coupler.

Referring now to FIGS. 5, 11-12 and 17-21, the opposite end of the coupler 52 provides a plug and socket type quick disconnect attachment with an end of the main body 16. In particular, the coupler 52 has a socket 120 with a tubular end 122 that receives a male plug end 124 of the main body 16 and fits inside of an end shroud 125 of the main body 16. The plug end 124 is retained in the socket 120 by a latch ring 126. As shown in FIG. 18, the latch ring 126 is generally ring-shaped element 127 with flat long sides and has a button 128 mounted at a short end by a snap-fit pin 129 and socket 131 connection. The latch ring 126 could, of course, be a single unitary component; however, it is shown in two parts here for ease of assembly. The latch ring 126 is slidably captured within a slot 130 in the coupler 52 and protrudes through opposite sides of the coupler 52. The latch ring 126 is biased by a spring 132 to be concentric with the main axis of the socket 120, as shown in FIGS. 5 and 19, so that a catch surface 134 of the latch ring 126 engages with a radial surface 136 of the plug end 124 to prevent axial separation of the main body 16 from the coupler 52.

The main body 16 car be quickly connected to the cleaning head 24 by sliding the plug end 124 into the socket 120. Doing so causes the radial surface 136 to cam against a ramped side 140 of the catch 134 and drive the latch ring 126 out of the way of the plug end 124, as shown in FIG. 20. Once the radial surface 136 passes the catch member 134 the spring 132 returns the latch ring 126 to its original position, as shown in FIG. 19. Depressing the button 128 against the spring 132 clears the catch member 134 from the radial surface 136 so that the plug end 1124 can be slid out of the socket 120, as shown in FIG. 21.

Figure 22:
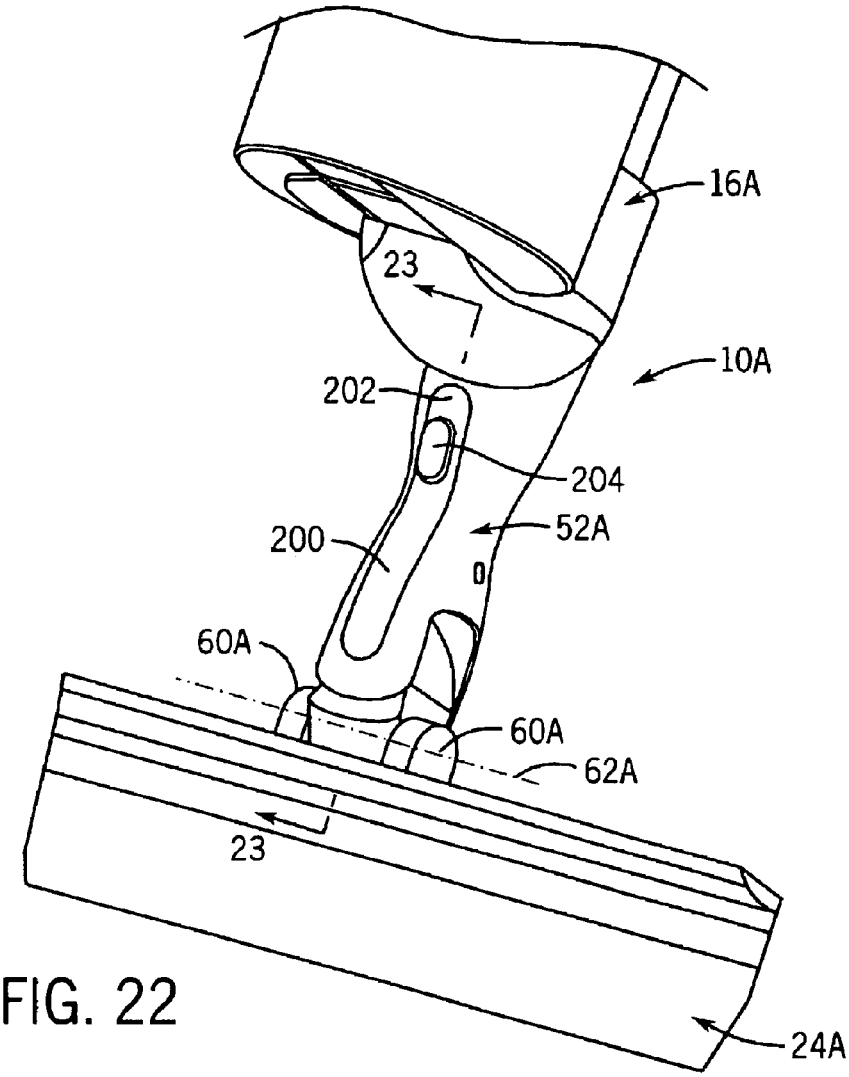
FIG. 22 is a partial perspective view of a second embodiment of the device having a quick disconnect coupler with opposing spring biased jaws.
Figure 23:
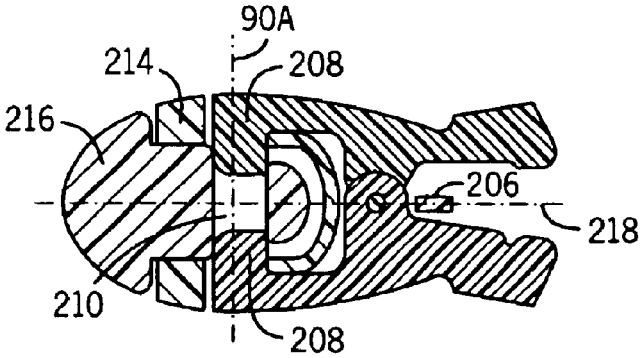
FIG. 23 is a partial cross-sectional view taken through line 23—23 of FIG. 22.

FIGS. 22 and 23 show an alternate embodiment of the cleaning device 10A of the present invention, shown here with a squeegee type cleaning head 24A and with a slightly modified main body 16A and retainer 20A assembly as well as an alternate coupler 52A assembly. Specifically, in this embodiment, the coupler 52A includes a coupler body 88A in which are pivotally mounted opposing jaws 200 having tail ends 202 with raised grips 204 biased outwardly by a spring 206. The spring 206 thus biases the jaws 200 to maintain teeth 208 in an opening 210 concentric with a swivel axis 90A of a swivel 212. Preferably, the swivel 212 has two parts 214 and 216 that are pivotally mated together about another swivel axis 218. The second part 216 is in turn pivotally mounted along a pivot axis 62A with spaced pivot mounts 60A fixed to the cleaning head 24A.

Depressing the grips 204 inwardly toward each other opens the jaws 200 and disengages the teeth 208 from the opening 210 in swivel part 212 so that the coupler 52A can be separated from the cleaning head 24A. The cleaning head 24A can be quickly reattached again by pressing in on the grips 204 and clamping the teeth 208 into the opening 210. This arrangement thus provides rapid connection and disconnection like the previously described embodiment. Also like before, this embodiment provides pivoting of the cleaning head 24A with respect to the main body 16A about two perpendicular pivot 62A and swivel 90A axes. In addition, it provides a fully 360 degree rotation about the third perpendicular swivel axis 218. Although not shown, various locking pins or other features could be provided to disable one or both of the swivel motions, as desired.

It should be appreciated that preferred embodiments of the invention have been described above. However, many modifications and variations to these preferred embodiments will be apparent to those skilled in the art, which will be within the spirit and scope of the invention. Therefore, the invention should not be limited to the described embodiments. To ascertain the full scope of the invention, the following claims should be referenced.

INDUSTRIAL APPLICABILITY

The invention is a trigger operated cleaning device having an improved pivotal connection for the cleaning head allowing rapid assembly and disassembly of the cleaning head.

What is claimed is:

1. A cleaning device, comprising:

a cleaning head;

a main body having a handle; and a quick disconnect coupler having a spring biased latch ring slidable with respect to the coupler and disposed around a part of the main body such that a latch surface of the latch ring is engagable with the main body for releasably attaching the cleaning head to the main body, the coupler allowing independent relative pivotal movement of the cleaning head with respect to the main body about two perpendicular axes.

2. The cleaning device of claim 1, wherein the coupler includes a swivel pivotal with respect to the main body about a first of the axes and pivotal with respect to the cleaning head about a second of the axes.

3. The cleaning device of claim 2, wherein the cleaning head includes a fixed pivot mount and the swivel is pivotally connected to the pivot mount along the second axis.

4. The cleaning device of claim 3, wherein the coupler further includes a body having a first end pivotally mounted to the swivel along the first axis.

5. The cleaning device of claim 4, wherein the coupler body has a second end adapted to engage an end of the main body in a latching plug and socket connection.

6. The cleaning device of claim 5, wherein the second end of the coupler body defines a socket receiving a plug end of the main body.

7. A cleaning device, comprising:

a cleaning head;

a main body having a handle; and a quick disconnect coupler adapted to releasably attach the cleaning head to the main body and allow independent relative pivotal movement of the cleaning head with respect to the main body about two perpendicular axes;

wherein the coupler includes a swivel pivotal with respect to the main body about a first of the axes and pivotal with respect to the cleaning head about a second of the axes;

wherein the cleaning head includes a fixed pivot mount and the swivel is pivotally connected to the pivot mount along the second axis;

wherein the coupler further includes a body having a first end pivotally mounted to the swivel along the first axis;

wherein the coupler body has a second end adapted to engage an end of the main body in a latching plug and socket connection;

wherein the second end of the coupler body defines a socket receiving a plug end of the main body;

wherein the coupler includes a button actuated spring biased latch ring disposed around the plug end of the main body when disposed in the socket and a catch engaging a radial surface of the plug end to prevent axial separation of the main body from the coupler body.

8. The cleaning device of claim 7, wherein the coupler includes a lock engagable with the swivel to prevent relative movement of the swivel and the coupler body.

9. The cleaning device of claim 8, wherein the lock is slidable and includes a stop movable into a radial slot in the swivel.

10. The cleaning device of claim 9, wherein the lock includes a grip extending to one side of the coupler body.

11. A cleaning device, comprising:

a cleaning head;

a main body having a handle; and a quick disconnect coupler adapted to releasably attach the cleaning head to the main body and allow independent relative pivotal movement of the cleaning head with respect to the main body about two perpendicular axes;

wherein the coupler includes a swivel pivotal with respect to the main body about a first of the axes and pivotal with respect to the cleaning head about a second of the axes;

wherein the cleaning head includes a fixed pivot mount and the swivel is pivotally connected to the pivot mount along the second axis;

wherein the coupler further includes opposing jaws engaging the swivel and pivotal about the second axis;

wherein the jaws are pivotally connected and biased together by a spring.

12. The cleaning device of claim 11, wherein the swivel has two parts pivotally mated about a third axis perpendicular to the first and second axes, a first part connected to the pivot mount of the cleaning head and a second part releasably connected to the jaws.

13. A cleaning device, comprising:

a cleaning head having a pivot mount;

a main body having a handle and a first quick disconnect part; and a coupler having a body with a second quick disconnect part releasably engaging the first quick disconnect part in a latching plug and socket connection so as to resist axial separation of the main body from the coupler body, the coupler further including a swivel pivot mounted to the connector body to pivot about a first axis and to the pivot mount to pivot about a second axis disposed in a plane perpendicular to the plane of the first axis;

wherein the first quick disconnect part is a male plug end and the second quick disconnect part is a socket;

wherein the coupler includes a button actuated spring biased latch ring disposed around the plug end of the main body when disposed in the socket and a catch engaging a radial surface of the plug end to prevent axial separation of the main body from the coupler body.

14. The cleaning device of claim 13, wherein the coupler includes a lock engagable with the swivel to prevent relative movement of the swivel and the coupler body.

15. The cleaning device of claim 14, wherein the lock is slidable and includes a stop movable into a radial slot in the swivel.

16. The cleaning device of claim 13, wherein the main body further includes an aerosol canister assembly for delivering a chemical from a canister to a desired location adjacent the cleaning head.

17. The cleaning device of claim 16, wherein the handle is part of a grip assembly having a trigger for moving an actuator assembly causing the chemical is to be dispensed from the canister when the trigger is depressed.

18. The cleaning device of claim 17, wherein the grip assembly is at an end of an extension wand connected to the aerosol canister assembly.

* * * * *